United States Patent [19]

Corniea

[11] Patent Number: 4,817,688

[45] Date of Patent: Apr. 4, 1989

[54] METHOD AND DEVICE FOR DRIVING DOUBLE BELLOWS PUMP

[75] Inventor: Donald G. Corniea, Inver Grove, Minn.

[73] Assignee: Liquipak International, Inc., St. Paul, Minn.

[21] Appl. No.: 39,731

[22] Filed: Apr. 20, 1987

[51] Int. Cl.[4] ..... B67D 5/40

[52] U.S. Cl. ..... 141/140; 222/381; 417/214

[58] Field of Search ..... 74/25; 417/214, 223, 417/319; 141/1, 129, 140, 142, 191, 311 R; 222/221, 249, 381, 487

[56] References Cited

U.S. PATENT DOCUMENTS

| | | | |
|---|---|---|---|
| 1,707,508 | 4/1929 | Case | 417/214 |
| 2,265,613 | 12/1941 | Richards | 417/223 |
| 2,951,618 | 9/1960 | Aldecoa | 141/156 X |
| 4,402,461 | 9/1983 | Mosse et al. | 222/381 X |
| 4,448,008 | 5/1984 | Pankratz et al. | 53/202 |
| 4,515,530 | 5/1985 | Christoleit | 417/214 |

*Primary Examiner*—Werner H. Schroeder

*Attorney, Agent, or Firm*—Burns, Doane, Swecker & Mathis

[57] ABSTRACT

A driving device for a double bellows dispensing unit is disclosed. The device includes a cylinder slidably mounted on a fixed vertical shaft and a plate mounted on the cylinder. The plate is connected with the dispensing unit. A rotary cam and cam follower cooperate to impart oscillating motion to the plate upon upward movement of the cylinder along the shaft. A control valve controls the flow of fluid under pressure to the cylinder for selectively displacing the cylinder in opposite directions. When the cylinder is displaced downwardly by the control valve, the cam and cam follower are disengaged, so that the oscillating motion stops.

14 Claims, 1 Drawing Sheet

METHOD AND DEVICE FOR DRIVING DOUBLE BELLOWS PUMP

BACKGROUND OF THE INVENTION

The present invention relates to automatic filling machines wherein empty cartons conveyed along a path are filled with liquid and sealed, and more particularly to liquid dispensing units for such machines.

High speed automatic filling machines such as is disclosed in U.S. Pat. No. 4,448,008, have been used for filling cartons with liquids, such as milk and juices.

These filling machines are required to dispense a predetermined quantity of liquid in each carton as it advances through the filling section of the machine. One type of dispensing unit that can be used is the double bellows type fluid handling apparatus such as that disclosed in U.S. Pat. No. 4,402,461. This patent discloses a dispensing unit having a pair of bellows interconnected by a tubular body containing a valve that controls the flow of fluid from the upper bellows to the lower bellows. The tubular body is mounted for reciprocating movement in an axial direction, and the end of each bellows that is connected with the tubular body moves with it. The opposite ends of the respective bellows are held stationary, so that the axial movement of the body in one direction compresses one of the bellows and expands the other. An actuator vertically raises the body to contract the upper bellows while simultaneously expanding the lower bellows. This action forces liquid from the upper bellows into the lower bellows. The actuator then lowers the body to expand the upper bellows while simultaneously contracting the lower bellows. This allows the upper bellows to be refilled with liquid and forces the liquid present in the lower bellows into a carton. The sequence is then repeated sequentially transferring liquid from a main source into the upper bellows, then into the lower bellows, and finally into individual cartons.

The actuator is described in U.S. Pat. No. 4,402,461 as an hydraulic or pneumatic ram. Control of the movement of the double bellows dispensing unit is accomplished by controlling the fluid pressure in the ram. Such a control device has the disadvantage that control of the ram involves frequent operation of several valves, components which are subject to wear and require periodic replacement. Another disadvantage of the prior art drive mechanism is that the fluid used to operate the ram is compressible. This causes the rate of displacement of the ram to decrease as the fluid pressure increases, and as a result, the stroke of the ram is difficult to adjust.

SUMMARY AND OBJECTS OF THE INVENTION

In view of the foregoing limitations and shortcomings of the prior art liquid dispensing units, as well as other disadvantages not specifically mentioned above, it should be apparent that, prior to the present invention, there existed a need for an efficient, durable and precise mechanism for driving a double bellows liquid dispensing unit. It is, therefore, a primary object of this invention to provide such a device.

More particularly, it is an object of this invention to provide a drive mechanism for a double bellows liquid dispensing unit that is reliably driven with a precise rhythmic cycle.

It is another object of this invention to provide a drive mechanism for a double bellows liquid dispensing unit that incorporates a minimum of parts that are subject to excessive wear or deterioration.

Yet another object of the present invention is to provide a drive mechanism for a double bellows liquid dispensing unit that is preset to move within a fixed pattern.

It is still another object of the present invention to provide a drive mechanism for a double bellows liquid dispensing unit that is able to interrupt its cycle in the event of a missing carton or a damaged carton appearing on the conveyor.

The aforementioned and other objects are accomplished according to the present invention by providing a cam operated drive mechanism for controlling the movement of the double bellows liquid dispensing unit. The drive mechanism for the dispensing unit includes a pneumatic double acting ram that is mounted on the frame of the machine. The shaft of the ram is secured to the frame of the machine so that it is stationary. The tubular body of the dispensing unit is secured to the cylinder of the ram which moves up and down along the stationary shaft. A rotary cam is mounted for rotation about a fixed axis adjacent the ram. A cam follower is mounted for movement with the tubular body into engagement with the cam. Control means are provided for actuating the ram to move the tubular body axially, so that the cam follower engages the cam surface of the rotating cam. The control means includes a sensor for displacing the cam follower out of engagement with the cam when a carton is not present under the discharge nozzle of the dispensing unit.

BRIEF DESCRIPTION OF THE DRAWINGS

Preferred embodiments of the present invention will be described in greater detail with reference to the accompanying drawings, wherein like members bear like reference numerals and wherein.

DETAILED DESCRIPTION OF THE INVENTION

Figure 1:
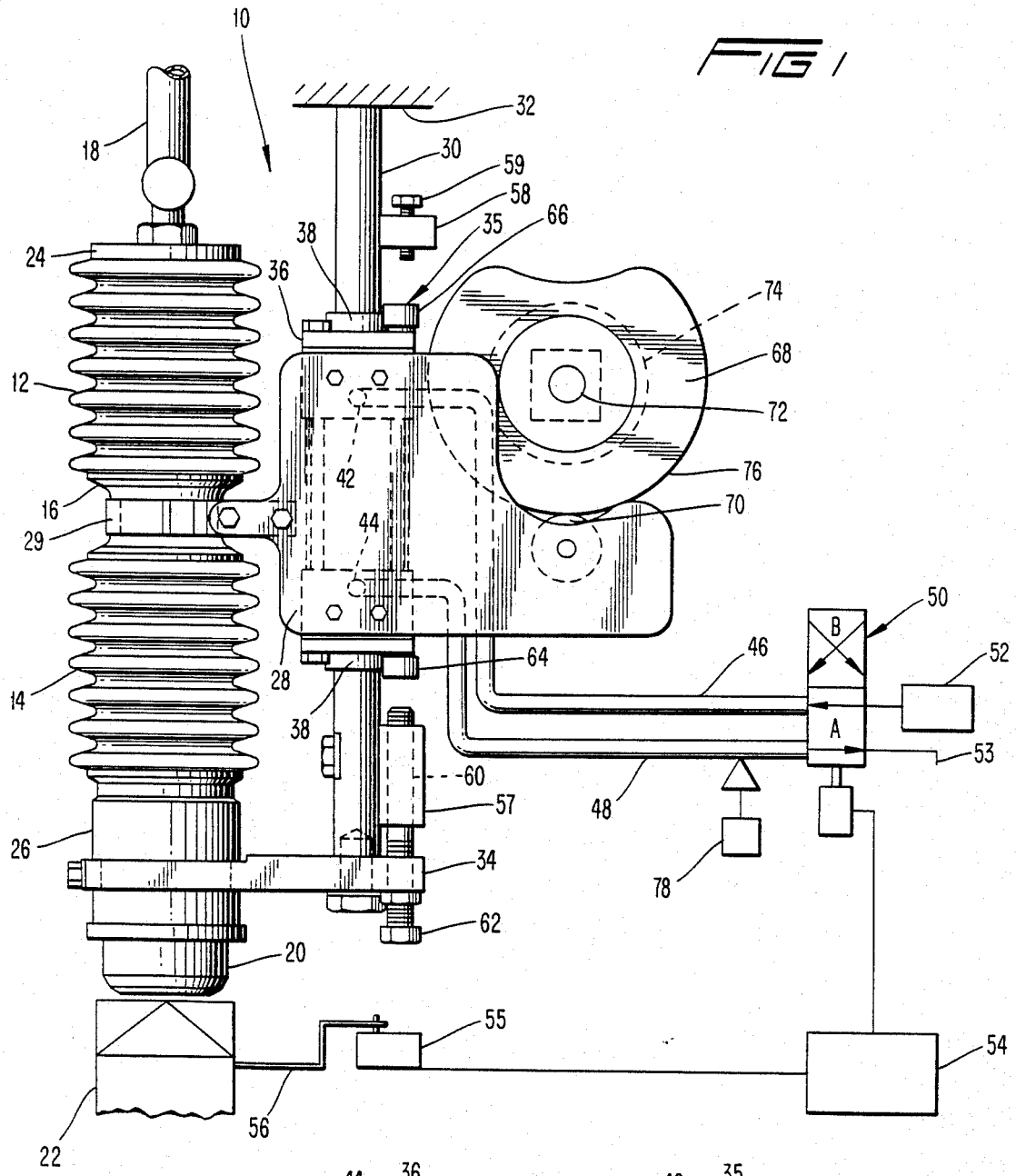
FIG. 1 is a side elevational view of the dispensing unit according to the present invention.

With reference to FIG. 1, a double bellows liquid dispensing unit 10 includes an upper bellows 12 and a lower bellows 14 interconnected by a tubular body 16. The upper and lower bellows are formed of a flexible material, such as blow-molded polypropylene, so that upon movement of the opposite ends of each bellows toward and away from each other, the fluid volume in the interior of the bellows contracts and expands, respectively. A check valve is positioned within the body 16 to permit the flow of liquid through the valve only in the direction from the upper bellows to the lower bellows. A fluid inlet pipe 18 feeds fluid into the upper bellows 12, and a nozzle 20 located below the lower bellows 14 guides the fluid into a carton 22 to be filled. The cartons 22 are conveyed on a conveyor (not shown) below a series of these dispensing units and are then sealed closed for shipping and storage.

The top 24 of the upper bellows 12 and the bottom 26 of the lower bellows 14 are fixed to a rigid support (not shown) in accordance with conventional practice. The tubular body 16 is supported for reciprocating movement in a vertical direction. When the body 16 is displaced axially upwardly, the upper bellows 12 contracts, forcing the fluid therein through the check valve in the body 16 and into the lower bellows 14, which expands to a corresponding extent. When the body 16 is displaced downwardly, the lower bellows 14 contracts, causing the check valve to close. The fluid pressure in the lower bellows then increases, and fluid flows through nozzle 20 into the carton 22 situated below it. Simultaneously, the upper bellows 12 is expanding to draw in fluid from the inlet pipe 18.

Connected to the body 16 is a plate or bar 28. This connection can be made in any practical manner, such as by bolting the plate 28 to collar 29 fastened around the body 16. In order to displace the body 16 vertically, a vertical shaft 30 is secured between two rigid supports 32 and 34 on the frame of the machine. The shaft 30 is preferably in the form of a stainless steel rod that is hard chrome plated. A double acting pneumatic ram 35 includes a cylinder 36 which is mounted concentrically on the shaft 30 for vertical displacement along the shaft 30. Conventional seal assemblies 38 are provided on each end of the cylinder 36.

Figure 2:
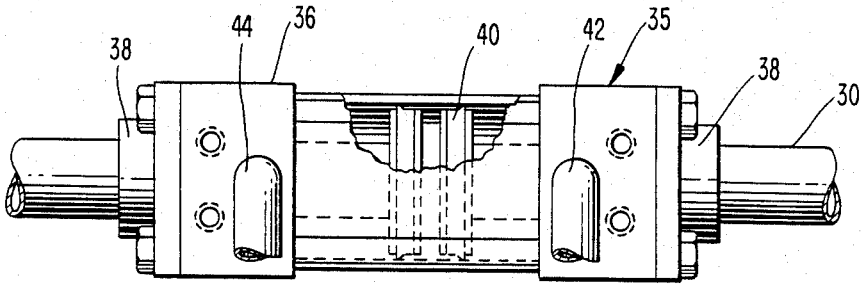
FIG. 2 is a detail view, partially broken away, of the ram assembly.

With reference to FIG. 2, the ram 35 has a piston 40 on the shaft 30 in the cylinder 36. The piston 40 is fixed relative to the shaft 30 and is preferably formed of an elastomeric material which maintains a sliding seal against the cylinder's interior wall. The piston 40 divides the interior of the cylinder 36 into two expansible chambers. Air under pressure flows into and out of the upper expansible chamber through a fitting 42. A similar fitting 44 is provided for the lower expansible chamber. Tubing 46, 48 respectively connects the upper and lower fittings 42, 44 with a control valve 50.

Pressurized air is supplied to the control valve 50 from a compressor 52. The control valve 50 is preferably in the form of a two position solenoid valve. When the valve spool is in the position shown in FIG. 1, air flows from the compressor 52 under pressure to the fitting 42 and into the upper expansible chamber of the ram 35. Air in the lower expansible chamber flows out through the fitting 44, through the valve 50 and through an exhaust port 53 to the atmosphere. The solenoid of the valve 50 operates in response to a control signal from a programmed logic circuit 54. The control valve has two positions designated "A" and "B" in FIG. 1.

A rotary limit switch 55 is positioned adjacent the nozzle 20 and has a rotary arm 56 arranged to engage and to be rotated by a carton under the nozzle. Thus, the position of the arm operates the switch to provide a signal to the programmed logic circuit 54 to indicate whether or not a carton is under the nozzle. The logic circuit 54 operates the solenoid of the valve 50 to maintain the spool with position "A" aligned with inlet port from the air compressor 52 and the tube 45, as shown in FIG. 1. This causes compressed air to flow into the cylinder 36 through fitting 42 to displace the cylinder 36 upwardly. Conversely, rotation of the arm 56 to a neutral position, such as by a spring, produces a signal from the logic circuit 54 which displaces the spool of the valve 50 downwardly so that position "B" is aligned with the compressed air inlet port. This causes the air in the upper part of the cylinder 36 to be exhausted to the atmosphere through the port 53 and compressed air to flow into the lower part of the cylinder through the fitting 44. This urges the cylinder 36 to be displaced downwardly.

A pressure regulator 78 controls the flow of air out of the fitting 44 when the valve 50 is in the position shown in FIG. 1. The regulator 78 maintains a predetermined pressure in the cylinder on the lower side of the piston 40 that is sufficiently low that the cylinder does not move downwardly at a greater rate than required by the cam 68. As a result, the double bellows dispensing unit which is connected to the cylinder 36 only moves downwardly (discharge direction) at a rate of speed that is controlled by the profile of the cam 68. This eliminates the need for speed controls on the pneumatic ram in either direction.

Vertical motion of the cylinder is limited by stop mechanisms 57 and 58 mounted on the shaft 30. The lower stop mechanism 57 is bolted to the frame member 34 and includes a threaded bore 60 through which a threaded bolt 62 extends. Downward travel of the cylinder 36 along shaft 30 is limited by the lower stop mechanism 57 when a bumper 64 mounted on the lower end of the cylinder 36 contacts the upper end of bolt 62. The lower stop mechanism 57 can be adjusted by the placement of the bolt 62 within the stop mechanism. Similarly, upper stop mechanism 58 includes an adjustable bolt 59 and operates in the same manner as the lower stop mechanism 56. A corresponding bumper 66 is provided on the upper end of the cylinder 36 to engage the bolt 59.

Oscillation of the tubular body 16 to accomplish the dispensing function is provided by a rotary cam 68 which engages a roller 70 which serves as a cam follower. The roller 70 is supported on the plate 28 which connects the cylinder 36 with the tubular body 16. The cam 68 is mounted on a rotary shaft 72, and is driven by a variable speed motor 74. The cam 68 is arranged in alignment with the cam follower 70, such that when the plate 28 is raised, the cam follower 70 engages in the cam surface 76. As shown in FIG. 1, the cam surface has a dwell that is greater than 180° which displaces the tubular body 16 downward. During the remaining approximately 90° of rotation, the rise of the cam surface is reduced, thereby allowing the follower 70 to move upward with the plate 28 and the tubular body 16.

The speed at which the cam 68 rotates determines the frequency at which the double bellows dispensing unit operates. The rise of the cam 68 determines the length of the stroke of the tubular body 16, which in part determines the rate of flow of liquid through the nozzle. In other words, the stroke of the double bellows fluid handling apparatus will be equal to the amount of eccentricity in the cam 68.

In operation, the bellows 12 and 14 are filled with liquid in a conventional manner. A series of open cartons 22 are arranged on a conveyor under the nozzle. The programmed logic circuit 54 instructs the valve 50 to direct air under pressure from the compressor 52 to the tube 46. The valve spool is in the position "A". The tube 46 directs the pressurized air to the inlet 42 and into the upper portion of the cylinder 36. This causes the cylinder 36, the plate 28, the tubular body 16 and the cam follower 70 to move vertically upward along the shaft 30 until the cam follower 66 engages in the cam surface 76. The motor rotates the cam 68 at a constant speed. The surface of the cam 68 causes the cam follower 66, and thus the plate 28, to reciprocate in a vertical direction. Movement of the plate 28 imparts a corresponding reciprocating movement to the tubular body 16.

When arm 56 of switch 55 detects a damaged or missing carton, or any other abnormal situation, a signal is sent to the programmed logic circuit 54, which in turn directs the valve 50 to shut off pressure to the tube 46 and to direct pressure to the tube 48. The spool of the valve is displaced to the "B" position. The air that is supplied flows through the tube 48 and enters the lower portion of the cylinder 36 through the inlet 44. At the same time the air in the upper portion of the cylinder is exhausted to the atmosphere through the port 53. This causes the cylinder 36 and the plate 28 to move downwardly until the bumper 64 on the cylinder contacts the end of the bolt 62 of the stop mechanism 57. With the plate 28 in this position, the tubular body 16 ceases to oscillate and no filling will take place.

To resume operation, a carton 22 is placed under the nozzle 20 and the programmed logic circuit 52 sends a signal to the valve 50 to cut off the flow of air under pressure to the tube 48 and to then apply it to the tube 46. As a result, the cylinder 36 and the plate 28 move upward and the cam follower 70 is urged against the cam surface 76. Preferably the cam 68 continues to rotate during momentary interruptions in the oscillation of the tubular body 16.

Although the present invention has been described herein the context of its application with a double bellows dispensing unit, it will be appreciated that other applications of the present invention are possible. Furthermore, the references to the vertical direction are intended as exemplary and not limiting. Thus, although a preferred ebodiment is illustrated and described herein, modifications and variations of the present invention are possible in light of the above teachings and within the purview of the appended claims without departing from the spirit and intended scope of the invention.

What is claimed is:

1. An oscillating drive assembly for a double bellows dispensing unit, comprising:

a frame member;

connection means for rigidly connecting said frame member to said double bellows dispensing unit;

a shaft mounted at a fixed position adjacent said dispensing unit;

a fluid cylinder slidably mounted on said shaft, said frame member being secured to said fluid cylinder;

a rotary cam and a cam follower, one of which being mounted on said frame member and the other of which being mounted at a fixed position;

bidirectional fluid motor means cooperating with said fluid cylinder for selectively urging the fluid cylinder in one of two directions, whereby said rotary cam and cam follower are engaged when the fluid motor means urges the fluid cylinder in a first direction, and the rotary cam and cam follower are disengaged when the fluid motor means urges the fluid cylinder in a second direction;

said rotary cam and cam follower are arranged so as to produce oscillation of said frame member along said shaft when said cam is rotating and when said rotary cam and cam follower are engaged; and controllable means for selectively controlling the fluid motor means whereby when said drive assembly is connected with said double bellows dispensing unit and the fluid motor means is urging said cam and cam following into engagement, rotation of said cam imparts oscillating motion to activate said dispensing unit.

2. The assembly according to claim 1, further comprising a piston in said cylinder for dividing said cylinder into two compartments.

3. The assembly according to claim 2, wherein said fluid motor means includes fluid conduit means for selectively supplying fluid under pressure to opposite sides of said piston to selectively displace said cylinder in opposite directions along said shaft.

4. The assembly according to claim 3, wherein said shaft extends substantially vertically, and said controllable means includes a control valve for selectively displacing said cylinder upwardly and downwardly along said shaft.

5. The assembly according to claim 4, wherein said rotary cam is at a fixed location and said cam follower is on said frame member and positioned relative to each other to urge said follower into engagement with said cam upon upward displacement of said cylinder along said shaft, and including motor means for rotating said cam at a substantially constant speed.

6. The assembly according to claim 4, wherein the controllable means includes a programmed logic circuit and a limit switch for producing a signal to the logic circuit in response to the absence of fillable cartons, and said logic circuit operating a control valve for selectively directing fluid pressure to said cylinder.

7. The assembly according to claim 4, including stop means on the shaft for limiting the movement of the cylinder along the shaft.

8. A double bellows dispensing unit having an oscillating drive assembly comprising:

a double bellows dispensing unit including a tubular body between a pair of bellows, said pair of bellows and said tubular body being in alignment along an axis;

a drive plate secured on said tubular body and extending laterally from said body;

a shaft mounted at a fixed position spaced from said body, said shaft extending substantially parallel to said axis;

a fluid cylinder secured on said drive plate, said shaft extending through said cylinder, said shaft having a piston secured on said shaft within said cylinder to provide first and second fluid chambers;

rotary cam means adjacent said shaft for imparting oscillating motion to said drive plate, said cam means including a rotary cam and follower;

said cylinder being arranged to displace said cam and follower into engagement with each other upon displacement of said cylinder in response to fluid pressure in said first chamber and out of engagement with each other upon displacement of said cylinder in response to fluid pressure in said second chamber; and control valve means for selectively directing a fluid under pressure to said first and second chambers.

9. The apparatus according to claim 8 wherein said unit includes a dispensing nozzle, said control valve means includes a limit switch and a program logic circuit, said limit switch being positioned adjacent said nozzle for producing a signal to the logic circuit in response to the absence of a fillable carton under said nozzle, said control valve means being controlled by said limit switch to direct fluid under pressure to said second chamber when there is an absence of a fillable carton under said nozzle, thereby interrupting the oscillating motion of said tubular body.

10. The apparatus according to claim 9 wherein said rotary cam is mounted at a fixed location and said follower is on said drive plate, and including a motor for rotating said cam at a constant speed.

11. A method of driving a double bellows dispensing unit, comprising the steps of:

providing a plate in rigid connection with the dispensing unit such that movement of the plate drives the dispensing unit along a fixed axis;

slidably fixing the plate along a guide axis parallel to said fixed axis;

rotating a cam at a constant speed adjacent the plate;

urging the plate with a bidirectional fluid motor in a first direction along said guide axis until a cam follower mounted on the plate contacts said rotary cam to produce an oscillating motion of said plate and dispensing unit; and selectively displacing the plate along said guide axis with the bidirectional fluid motor in a direction opposite to said first direction to disengage said cam and cam follower to stop the oscillating motion of said dispensing unit.

12. The method according to claim 11, includes sensing the absence of a carton in a position to be filled by said unit;

generating a signal upon said sensing; and activating said displacing step in response to said signal.

13. The method according to claim 12, wherein the sensing step includes placing a movable member to be moved by a carton in position to be filled and generating said signal in response to movement of said member.

14. The method according to claim 12, wherein the step of urging the plate in said first direction includes applying fluid pressure to a movable cylinder, said urging step continuing while said signal is not present.

* * * * *